US007000789B2

(12) United States Patent
Miceli et al.

(10) Patent No.: US 7,000,789 B2
(45) Date of Patent: Feb. 21, 2006

(54) TWO PIECE REVERSIBLE CHILD RESISTANT CLOSURE

(75) Inventors: David A. Miceli, Spencer, TN (US); Joseph Miceli, Spencer, TN (US)

(73) Assignee: Tri State Distribution, Inc., Spencer, TN (US)

( * ) Notice: Subject to any disclaimer, the term of this patent is extended or adjusted under 35 U.S.C. 154(b) by 19 days.

(21) Appl. No.: 10/356,493

(22) Filed: Feb. 3, 2003

(65) Prior Publication Data

US 2004/0226907 A1 Nov. 18, 2004

Related U.S. Application Data

(60) Provisional application No. 60/353,235, filed on Feb. 4, 2002.

(51) Int. Cl.
*B65D 50/04* (2006.01)

(52) U.S. Cl. ..... 215/228; 215/220; 215/330; 215/217; 215/204

(58) Field of Classification Search ..... 215/228, 215/216–221, 230, 277, 330, 331, 204
See application file for complete search history.

(56) References Cited

U.S. PATENT DOCUMENTS

| | | | | |
|---|---|---|---|---|
| 942,141 | A | | 12/1909 | Hoffman |
| 1,435,723 | A | | 11/1922 | Mayer |
| 2,054,031 | A | | 9/1936 | Conner et al. |
| 3,344,942 | A | | 10/1967 | Hedgewick |
| 3,435,975 | A | | 4/1969 | Weigand |
| 3,557,985 | A | | 1/1971 | St. Denis et al. |
| 3,612,324 | A | | 10/1971 | Malick |
| 3,795,338 | A | | 3/1974 | Swartzbaugh et al. |
| 3,865,267 | A | | 2/1975 | Morris |
| 3,881,625 | A | * | 5/1975 | Landen ..... 215/221 |
| 3,884,379 | A | * | 5/1975 | Landen ..... 215/221 |
| 3,951,289 | A | | 4/1976 | Landen |
| 4,006,836 | A | | 2/1977 | Micallef |
| 4,011,960 | A | | 3/1977 | Mauvernay et al. |
| 4,223,793 | A | | 9/1980 | Patton |
| 4,271,971 | A | | 6/1981 | Morris |
| 4,281,771 | A | | 8/1981 | Siegel |
| 4,334,638 | A | | 6/1982 | Stock |

(Continued)

FOREIGN PATENT DOCUMENTS

DE 29 27 339 A1 1/1981

(Continued)

*Primary Examiner*—Nathan J. Newhouse
*Assistant Examiner*—James N. Smalley
(74) *Attorney, Agent, or Firm*—Waddey & Patterson, P.C.; Phillip E. Walker

(57) ABSTRACT

A reversible child-resistant closure system including a closure and container. The closure has a child resistant mode when applied to the container in a first child-resistant position and has a non-child resistant mode when applied to the container in a second non-child resistant position. The closure includes an outer cap and an inner cap. The inner cap is coaxially positioned and nested within the outer cap such that a plurality of angular abutment surfaces of the inner cap engage a series of angular abutments of the outer cap upon rotation of the outer cap to rotate the inner cap in a closing direction. However, upon rotation of the outer cap member in an opening direction in the absence of an axial force, the angular abutment surfaces of the inner cap cam over and past the series of angular abutments of the outer cap, preventing rotation of the inner cap.

19 Claims, 5 Drawing Sheets

U.S. PATENT DOCUMENTS

| | | | | | |
|---|---|---|---|---|---|
| 4,387,821 | A | | 6/1983 | Geiger | |
| 4,433,789 | A | * | 2/1984 | Gibilisco | 215/220 |
| 4,452,364 | A | | 6/1984 | Kay | |
| 4,469,233 | A | | 9/1984 | Wegscheid | |
| 4,526,281 | A | | 7/1985 | Herr | |
| 4,553,678 | A | | 11/1985 | Thorsbakken | |
| 4,676,388 | A | | 6/1987 | Kuboshima | |
| 4,694,968 | A | | 9/1987 | Proctor et al. | |
| 4,729,487 | A | | 3/1988 | Wright | |
| 4,823,967 | A | | 4/1989 | Thompson | |
| 4,832,218 | A | | 5/1989 | Gibilisco | |
| 4,991,729 | A | | 2/1991 | Hunter | |
| 5,082,129 | A | * | 1/1992 | Kramer | 215/221 |
| 5,115,928 | A | | 5/1992 | Drummond, Jr. | |
| 5,190,178 | A | | 3/1993 | Luch | |
| 5,246,123 | A | | 9/1993 | Kramer et al. | |
| 5,317,796 | A | | 6/1994 | Hunter | |
| 5,394,999 | A | * | 3/1995 | Krall | 215/216 |
| 5,449,078 | A | | 9/1995 | Akers | |
| 5,462,182 | A | * | 10/1995 | Opresco | 215/216 |
| 5,464,110 | A | | 11/1995 | Heyworth | |
| 5,579,934 | A | | 12/1996 | Buono | |
| 5,611,443 | A | * | 3/1997 | King | 215/220 |
| 5,711,442 | A | | 1/1998 | Kusz | |
| 5,769,252 | A | | 6/1998 | Volpe | |
| 5,791,515 | A | | 8/1998 | Khan et al. | |
| 5,819,967 | A | | 10/1998 | Lo | |
| 5,819,968 | A | | 10/1998 | Jones | |
| 5,836,465 | A | | 11/1998 | King | |
| 5,865,330 | A | | 2/1999 | Buono | |
| 5,899,348 | A | | 5/1999 | Konefal et al. | |
| 5,924,588 | A | | 7/1999 | Brennan | |
| 5,927,532 | A | | 7/1999 | Traub | |
| 5,934,492 | A | | 8/1999 | Jones | |
| 5,988,413 | A | | 11/1999 | Nagel | |
| 6,082,565 | A | | 7/2000 | Harrold | |
| 6,446,823 | B1 | | 9/2002 | Miceli et al. | |
| 6,802,427 | B1 | * | 10/2004 | Miceli et al. | 215/228 |

FOREIGN PATENT DOCUMENTS

| | | |
|---|---|---|
| EP | 0 792 818 A1 | 3/1997 |
| WO | WO 01/64529 A2 | 9/2001 |

* cited by examiner

TWO PIECE REVERSIBLE CHILD RESISTANT CLOSURE

This application claims priority to U.S. Provisional Application No. 60/353,235 filed Feb. 4, 2002.

FIELD OF THE INVENTION

The present invention relates to a closure that may be applied to a vial or other container in either a child resistant configuration or a non-child resistant configuration. In its child resistant configuration, the closure provides an obstacle to children being able to remove the closure from the container. However, in its non-child resistant configuration, the closure allows for its ready removal from the container. The present invention also provides a closure and container assembly.

BACKGROUND OF THE INVENTION

There are many types of child resistant closure systems disclosed in the art. An example of a particular type of child resistant closure system is disclosed in U.S. Pat. No. 5,449,078, which relates to a combination of a container and safety cap. While many child resistant caps effectively provide protection against the danger of small children being able to remove potentially harmful pills from vials or other containers, they also provide a problem for a considerable portion of the adult population that require medication who lack the manual dexterity or strength to remove the child resistant cap. This is of a particular concern to the elderly population or people suffering from arthritis and other disabling diseases.

The most popular type of child-resistant closure is known in the art as a continuous threaded, torque actuated child resistant closure. These caps involve the use of two parts, one of which rests above the other in an axial configuration and which requires both a rotational and downward action to engage for removal. These are used in literally thousands of various applications and packaging configurations due to the universally understood push and turn mechanisms and ease of use and adaptation in a wide variety of automated filing lines and processes. They have become the most prominent and widely accepted solution for packaging requiring child resistant closures. Therefore, any invention designed to overcome the difficulty many senior members of the population experience when attempting to open child-resistant closures should involve, as the basis of its design, a standard two piece, push and turn, torque actuated continuous threaded closure due to their popularity and universal use.

This particular problem has been addressed by the development of closure systems having a child resistant mode and a non-child resistant mode such that, in the non-child resistant mode, the closures are more easily opened by adults. Another example of such a closure is disclosed in U.S. Pat. No. 5,579,934, (the '934 patent) which is herein incorporated by reference. The '934 patent discloses a container closure that is selectively manipulable between a configuration which resists opening by children and a configuration which may be easily opened without special manipulation of the closure. Specifically, the closure is manipulated into its non-child resistant mode by "pressing down" on the central portion of the top surface of the closure. Although the aforementioned closure effectively provides protection against the danger of small children being able to remove it from vials or other containers, a certain portion of the adult population lack the manual dexterity or strength to "press down" the central portion of the top surface of the closure so to manipulate the closure from its child resistant configuration to its non-child resistant configuration. This manipulation or "pushing down" also represents a problem for people with long fingernails. Other reversible child resistant closures have been developed to address this problem. But making the closure easier to convert into the non-child resistant configuration increases the risk that the closures will inadvertently be converted into their non-child resistant configurations. Similarly, there is an increased risk that automated filling machines will inadvertently convert the closures into their non-child resistant configurations when applying the closure to the container.

Further, the closures of the type disclosed in the '934 patent cannot include a warning to the consumer once the closure has been converted to its non-child resistant configuration. This message is required by the Consumer Product Safety Commission ("CPSC") to alert users that the closure has been converted into the non-child resistant configuration. Also, other reversible child resistant designs that do include the CPSC consumer warning cannot be used in automated dispensing equipment due to projections on their outer surface.

Furthermore, in child resistant caps comprising two or more elements such as an inner cap element nested within an outer cap element, and equipped with an engaging means for rotatably coupling one element to the other such as disclosed in U.S. Pat. No. 4,520,938, the inventors have observed that where the outer cap is made of resilient material such as plastic, a risk exists that children could separate one cap from the other thereby disabling the child resistance mode of operation. This process is known as "shelling" whereby the outer cap is rotated inward with a child's fingers and or teeth under one edge until it pops off, leaving the inner cap exposed. Moreover, as is most often the case in the prior art, the torque required to disengage the closure in the child resistant configuration is invariably the same torque applied to engage the closure in the first place. This means that without an indicator showing that full and complete closure has been attained, an elderly or infirm person could leave such caps partially closed in the child resistant mode thereby exposing it to the risk that a child could disengage the cap even though it had been supposedly closed in the child-resistant mode. When a complete closure indicator is incorporated, it ensures that not only will a user know when the closure is fully closed, but also that a minimal torque threshold would be needed to disengage the complete closure indicator before rotatably removing the closure from the container.

In light of the foregoing, there is a need for a continuous threaded, torque actuated child resistant closure that has a child resistant mode which resists opening by children, is not susceptible to shelling, has a non-child resistant mode which may be easily opened without special manipulation, resists inadvertent conversion from its child resistant mode to its non-child resistant mode, incorporates a mechanism to ensure both complete closing and minimal torque threshold requirements for opening, is capable of including the mandated CPSC warning "CAUTION NOT CHILD RESISTANT" when used in its non-child resistant mode, and can be used in automated dispensing machines so as to overcome the aforementioned deficiencies of the prior art.

SUMMARY OF THE INVENTION

Accordingly, the present invention is directed to a closure that substantially obviates one or more of the problems due to limitations and disadvantages of the related art. Additional features and advantages of the invention will be set forth in the description which follows, and in part will be apparent from the description, or may be learned by practice of the invention. The objectives and other advantages of the invention will be realized and attained by the apparatus particularly pointed out in the written description and claims hereof as well as in the appended drawings.

To achieve these and other advantages and in accordance with the purpose of the invention, as embodied and broadly described, the reversible child resistant closure of the present invention is for use with a container having a neck portion, an engaging means located thereon, and an axis extending therethrough about which the closure is rotatable. The closure has a child resistant mode when applied to the container in a first child resistant orientation and has a non-child resistant mode when applied to the container in a second non-child resistant orientation. The closure includes an outer cap and an inner cap. The outer cap includes a circumferential sidewall that extends from a top edge to a bottom edge, and a circumferential inner wall segment connected at its upper edge to the circumferential sidewall, but spaced apart therefrom at its lower edge so as to form an annular channel for slottable engagement with the inner cap. The circumferential sidewall is tapered at its top edge and has formed therein a non-child resistant engaging means for rotatable engagement with the engaging means of the container. The lower edge of the circumferential inner wall segment has a first child resistant engaging means flush with the bottom edge of said inner wall segment comprising a series of angular abutments extending about the surface of the inner wall segment.

The inner cap includes a first circumferential sidewall extending axially from an upper surface past a closure plane and ending as a circumferential inner skirt inside of a second circumferential sidewall. The circumferential inner skirt is designed to snugly fit inside the neck of the container when the cap is applied in the child resistant mode. The first and second circumferential sidewalls of the inner cap are connected at the closure plane. The second circumferential sidewall of the inner cap extends above and below the closure plane. The inner surface of the second circumferential sidewall of the inner cap, below the closure plane, is provided with a second child resistant engaging means for rotateable engagement with the engaging means of the container. Above the closure plane, the second circumferential sidewall of the inner cap extends as an annular lip for slottable engagement with the annular channel on the outer cap. Radially offset from the inner surface of this annular lip is a third child resistant engaging means having a plurality of angular abutment surfaces complementary to the series of angular abutments on the inner wall segment of the outer cap.

The inner cap is coaxially positioned and nested within the outer cap and is axially movable between the first child resistant engaging means and the bottom edge of the outer cap such that the plurality of angular abutment surfaces of the inner cap can engage the series of angular abutments of the outer cap upon rotation of the outer cap to rotate the inner cap in a closing direction. However, upon rotation of the outer cap member in an opening direction in the absence of an axial force, the plurality of angular abutment surfaces of the inner cap cam over and past the series of angular abutments of the outer cap, thus free wheeling and preventing rotation of the inner cap. Optionally, to ensure that a minimum threshold of axial force must be overcome to obtain cap removal in the child resistant configuration, the cap may be equipped with a complete closure indicator. For example, the bottom edge of the second circumferential sidewall may comprise one or more complete-closure indicating means for engagement with a complimentary means disposed on the neck of the container. This complete closure mechanism may be triangular or semicircular in design and engineered and sized to provide specific minimum torque requirement for cap removal.

In another aspect, the present invention includes a closure system being the combination of the closure of the present invention and a container.

It is to be understood that both the foregoing general description and the following detailed description are exemplary and explanatory and are intended to provide further explanation of the invention as claimed.

The accompanying drawings are included to provide a further understanding of the invention and are incorporated in and constitute part of this specification, illustrate several embodiments of the invention and together with the description serve to explain the principles of the invention.

BRIEF DESCRIPTION OF THE DRAWINGS

In the drawings, wherein like reference numerals identify similar elements throughout several views.

DETAILED DESCRIPTION OF THE PREFERRED EMBODIMENTS OF THE PRESENT INVENTION

Figure 1A:
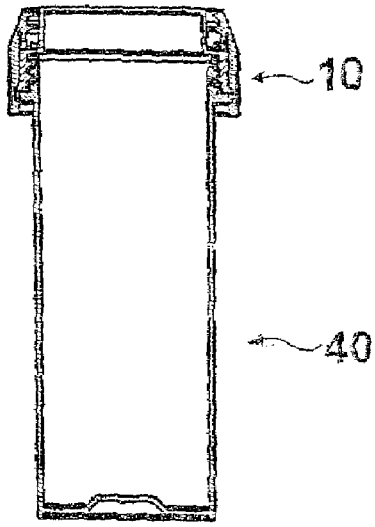
FIG. 1A is a cross sectional view of the cap and the container in the child resistant mode.
Figure 1B:
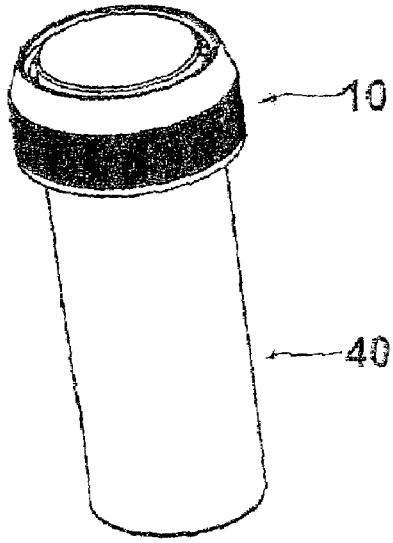
FIG. 1B is a side and top perspective view of the cap and container in the child resistant mode.
Figure 1C:
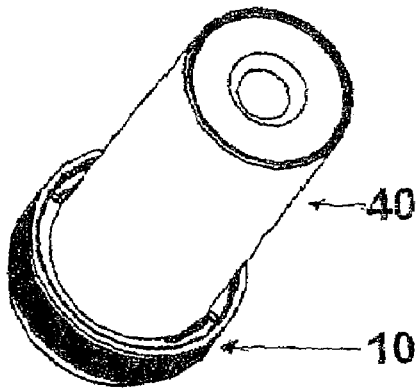
FIG. 1C is bottom and side perspective view of the cap and container in the child resistant mode.
Figure 2A:
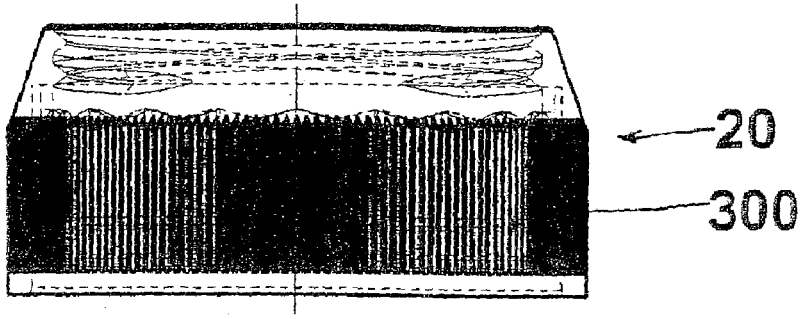
FIG. 2A is a side view and partial cross sectional view of the outer cap illustrating the non-child resistant engaging means.
Figure 2B:
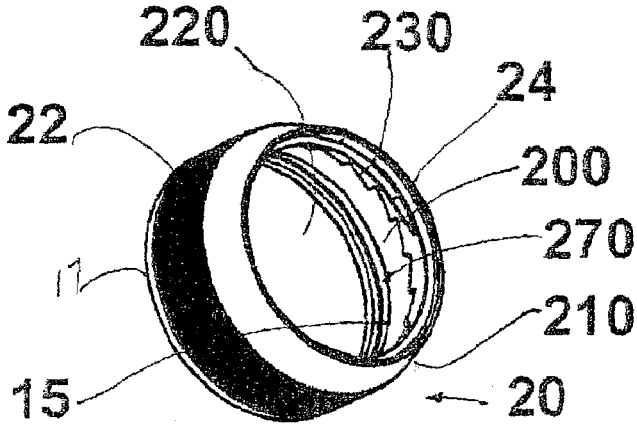
FIG. 2B is a top and side perspective view of the outer cap.
Figure 2C:
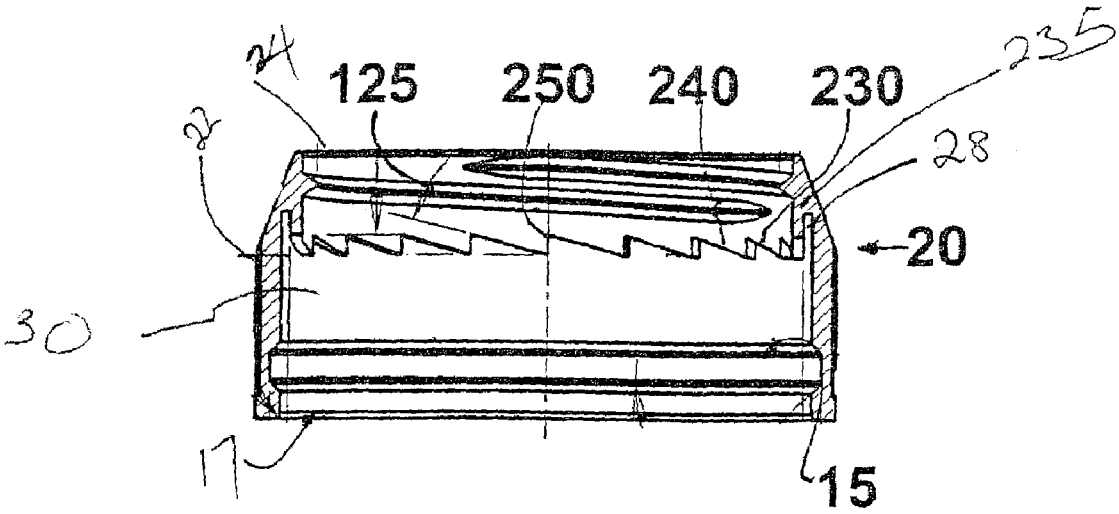
FIG. 2C is a cross sectional view of the outer cap with the inner cap nested therein.

Referring now to the drawings of the present disclosure in which like numbers represent the same structure in the various views, FIGS. 1A, 1B, and 1C show a reversible child resistant closure system in accordance with the present invention in its child resistant mode. The closure system comprises a reversible child resistant closure 10 and a container 40. As shown in FIGS. 2A, 2B and 2C, the closure 10 includes an outer cap 20 and an inner cap 30. The closure 10 is constructed for use with a container 40 having any suitable engaging means, for example, a threaded neck portion 50, and is primarily directed for use with containers which store and dispense pharmaceutical products and the like but may also be used with any container having a suitable engaging means, irrespective of its contents. As will be described in more detail below, the inner cap 30 is coaxially positioned and nested within the outer cap 20 such that it is movable between a child resistant engaging means of the outer cap 20, shown in the embodiment at FIGS. 2B and 2C as a series of angular teeth 230, and the bottom edge 15.

Figure 3A:
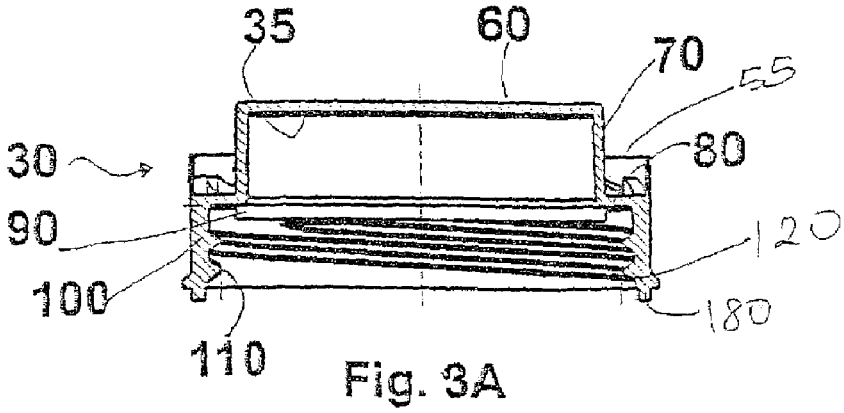
FIG. 3A is a cross sectional view of the inner cap.
Figure 3B:
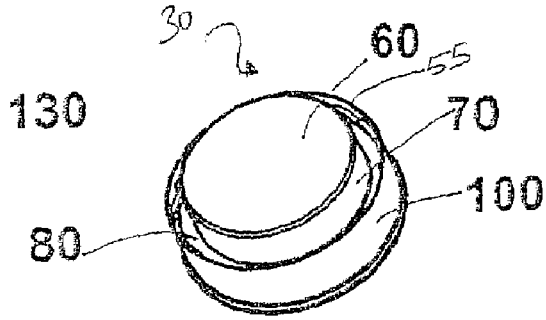
FIG. 3B is a top and side perspective view of the inner cap.
Figure 3C:
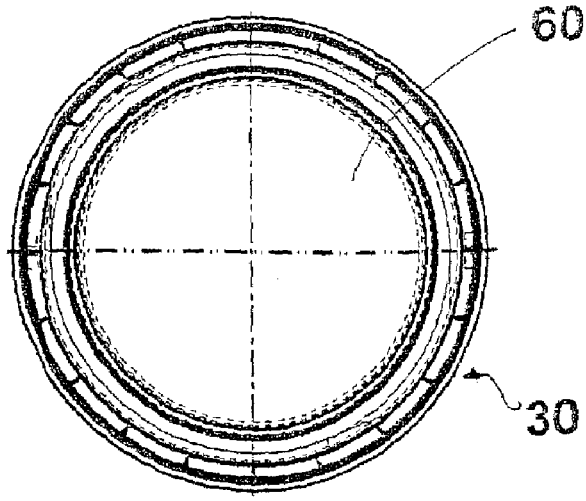
FIG. 3C is a top perspective view of the inner cap.
Figure 3D:
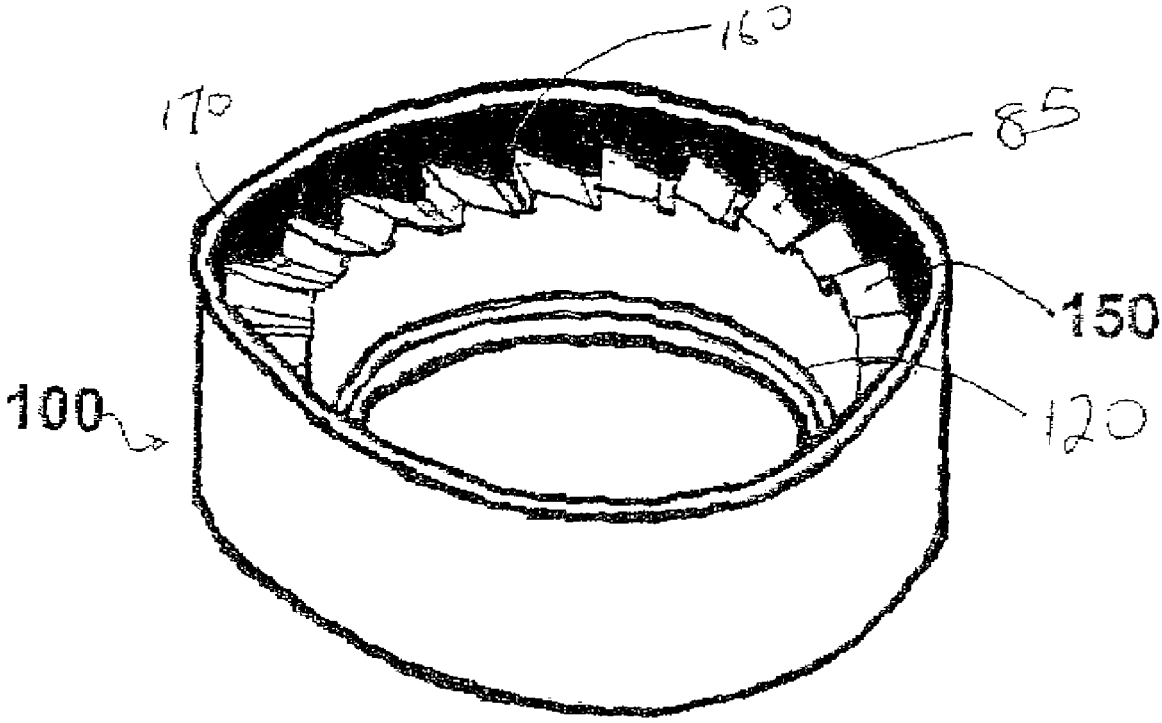
FIG. 3D is a top and side perspective view of the second circumferential sidewall of the inner cap.
Figure 4A:
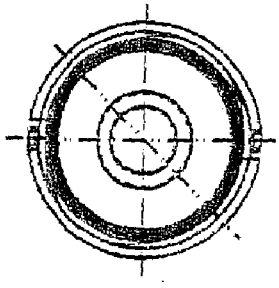
FIGS. 4A and 4B is a top perspective view of the containers.
Figure 4B:
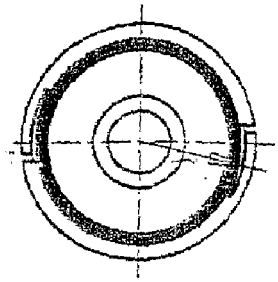
Figure 4C:
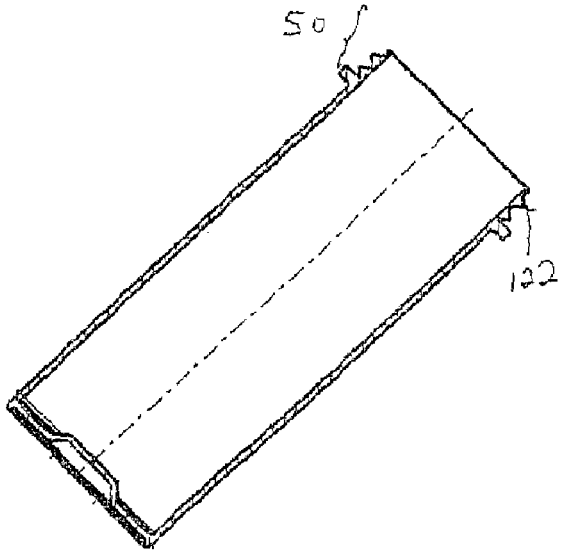
FIG. 4C is a cross sectional view of the container.
Figure 4D:
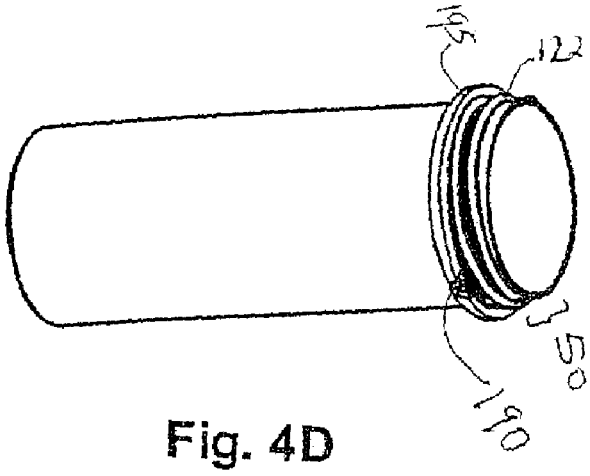
FIG. 4D is a side and top perspective view of the container.

As best shown in FIGS. 3A, 3B and 3C the inner cap includes an upper surface 60 that has a first circumferential sidewall 70 extending from the upper surface 60, through a closure plane 80 and continues on as an annular skirt 90 into the interior of the second circumferential sidewall 100. The second circumferential sidewall 100 extends above and below the closure plane and has an inner surface 110 below the closure plane which includes an engaging means for rotatably engaging the engaging means of the container. Any suitable engaging means for rotatable engagement may be used. For example the engaging means may be a thread bead for engaging the threaded exterior surface portion 50 of the container 40 shown in FIG. 4D. Preferably, the engaging means is a single thread bead. More preferably, as shown in FIG. 4D, the engaging means is a double thread bead 122. Above the closure plane 80, the second circumferential sidewall 100 of the inner cap 30 provides an annular lip 55. Disposed around this annular lip 55, adjacent the inner surface thereof is a child resistant portion comprising a series of angular abutments 85. (See FIGS. 3A and 3D.) As shown in FIG. 3D, preferably the series of angular abutments extend upward from the closure plane 80. As can best be seen from FIG. 3D, each tooth 85 forming the series of angular abutments of the child resistant portion of the inner cap 30 has a first sloped surface 150 and a second substantially vertical surface 160. The first sloped surface 150 and the second substantially vertical surface 160 define an angle θ which is preferably in the range of from about 22° to about 45°, and is more preferably about 25° to about 33°. Each tooth may abut directly with the next, or may be spaced apart by surface 170. Preferably each tooth abuts directly with the next. Any suitable numbers of teeth may be utilized, however, preferably between twenty (20) and fifty (50) teeth 85 are included. Most preferably, the inner cap 30 comprises about thirty six (36) individual teeth.

In a preferred embodiment, as best shown in FIG. 3A, the upper surface 60 of the inner cap 30 has an inner surface 35. To comply with CPSC requirements, the inner surface 35 includes a warning, for example "CAUTION NOT CHILD RESISTANT." A liner in the shape of a disc may also be included such that it fits inside the inner cap adjacent and parallel to the inner surface 35. If a liner is used, then the visible side of the liner may also include a warning, for example "CAUTION NOT CHILD RESISTANT."

Referring now to FIGS. 2B and 2C, the outer cap 20 has a circumferential sidewall 22 extending from a top edge 24 to a bottom edge 17 and has an inner surface 200 and an outer surface 210. The outer surface 210 may further comprise a gripping means to facilitate rotation of the closure 10 to aid both putting the closure on the container 40 and subsequent removal. Any suitable gripping means may be utilized. In a preferred embodiment, knerlments 300 are disposed about the outer surface 210 of the outer cap 20. Preferably, the top edge 24 surrounds a central opening 220 which can be best seen in FIG. 2B.

The inner surface 200 of the outer cap 20 comprises a non-child resistant engaging means for rotatably engaging the engaging means of the container 40. Any suitable engaging means may be used that is complementary to the engaging means of the container 40. For example, as shown in FIGS. 2B and 2C, the non-child resistant engaging means may be a thread bead for engaging the threaded exterior surface portion 50 of the container 40. Preferably, the engaging means is a single thread bead. More preferably, as shown in FIG. 2C, the engaging means in a double thread bead 125.

The inner surface 200 of the outer cap 20 further has an inward depending inner wall segment 235 that is spaced apart from the inner surface of the outer cap at its lower edge. As shown in FIG. 2C, the separation between the side wall of the outer cap 22 and the inward depending inner wall segment 235 defines an annular channel 28 designed to engage the annular lip 55 of the second circumferential side wall of the inner cap. The combination of this annular channel 28, the annular lip 55 of the inner cap and the ridge 270 at the bottom edge 15 of the outer cap, provide a tamper-proof means resisting the ability of a child to strip the outer cap off the inner cap, thereby disabling the child resistant means.

Flush with the bottom edge of the inner wall segment 235 of the outer cap 20 is a child resistant region which includes a plurality of angular abutment surfaces which are of size, position and orientation to complement the series of angular abutments extending from the outer surface of the child resistant portion of the second circumferential sidewall 100 of the inner cap 30. As shown in FIG. 2B, the angular abutments are preferably in the form of angular teeth 230, each tooth having a first sloped surface 240 and a second substantially vertical surface 250. The first sloped surface 240 and the substantially vertical surface 250 define an angle α preferably ranging from about 22° to about 45°, and more preferably about 25° to about 33°. The outer cap 20 may have any suitable numbers of such sloped first surfaces 240. In the preferred embodiment show in the FIG. 2B, the ratio of the teeth of the inner cap to the angular teeth 230 of the outer cap is one to one. However, any other integral ratio may be used, for example, two to one, three to one, or the like. In a more preferred embodiment, thirty six (36) sloped surfaces 240 are used which compliment the thirty six (36) teeth 85 of the preferred inner cap 30.

The angular abutment surfaces on the outer cap 20 are angled in the same direction as the series of angular abutments extending from the closure plane of the inner cap. Further, angles θ and α defined by the abutments of the outer cap 20 and the inner cap 30 respectively are preferably close to each other. Thus, when the closure 10 is in its child resistant mode as shown in FIG. 1B, and when the outer cap 20 is rotated in the opening direction, the abutment surfaces of the outer cap 20 will ratchet or ride over the angular abutment surfaces of the inner cap 30, thereby permitting rotation of the outer cap 20 relative to the inner cap 30. This, however, can be overcome by the application of an axial force on the outer cap 20 toward the inner cap 30 in combination with rotation of the outer cap 20 in the opening direction, which prevents the ratcheting of the angular abutment surfaces of the outer cap 20 over the angular abutment surfaces of the inner cap 30, which in turn causes the inner cap 30 to rotate with the outer cap 20 in the opening direction.

Thus, to convert the closure 10 from its child resistant mode to its non-child resistant mode simply requires the user to remove the closure 10 from the container 40 invert the closure 10 and simply rotatably re-attach the closure 10 to the container 40 by rotating the closure 10 in a closing direction which is preferably clockwise. The inner surface 200 may also include a ridge 270 which prevents the inner cap 30 from moving past the child resistant region and out of nesting relation with the outer cap 20.

In order to convert the child resistant closure 10 from its non-child resistant mode to its child resistant mode as shown in FIG. 1B, the user simply removes the closure 10 from the container 40 by rotating the closure in an opening direction, preferably counter-clockwise, inverts the closure 10 and then simply rotatably re-attaches the closure 10 to the container 40 by rotating the closure 10 in a closing direction, which is preferably clockwise.

In order to utilize a preferred embodiment of the closure 10 when in a child resistant mode, as shown in FIG. 1B, the closure 10 is first placed on the threaded portion 50 of the container 40 by threadedly engaging thread 120 on inner cap 30 with the threaded portion 50. A rotative force turns the outer cap 20 in the closing direction, here shown to be clockwise. The substantially vertical surfaces 160 of the teeth on the inner cap 30 and sloped first surfaces 240 on the outer cap 20 interengage to cause the inner and outer caps to turn together, e.g. to cause the inner cap 30 to remain rotationally stationary relative to the outer cap 20, to close the container. Upon closing the container 40 further rotation of the closure 10 in the closing direction is prevented.

Optionally, to aid people in realizing when complete closure has been attained, the bottom edge of the second circumferential sidewall of the inner cap may comprise complete-closure indicating means 180 (FIG. 3A) for engagement with a complimentary means disposed on the neck of the container beneath the threaded region. Any complete-closure indicating means can be used. A preferred embodiment would include one or more tabs or projections extending from the bottom edge of the second circumferential sidewall of the inner cap designed to fit into one or more complimentary depressions 190 (FIG. 4D) formed in the flange 195 of the threaded portion of the container. The complimentary depressions 190 may be a dimple, cavity, detent, slot or any other like means known in the art for accepting such tabs or projections to register complete closure. The complete-closure indicating means may be designed in such a way that a minimal torque threshold must first be reached to allow disengagement of the complete-closure indicating means before rotatably removing the closure from the container by means of the threaded portion.

Rotation of the closure 10 in the counterclockwise direction will cause the sloped first surfaces 240 of the outer cap 20 to ratchet or ride over the first sloped surfaces 150 of the teeth of the inner cap 30. That is to say, the mere turning of the outer cap 20 in the opening direction will not rotate inner cap 30 in an opening direction because there is no transmission of torque from the outer to the inner cap as the sloped first surfaces 240 ride over and slide by the sloped first surfaces 150. In order to open the closed container 40 with closure 10 in its child resistant mode, the user must utilize both a rotative and an axial force. It is the axial force that prevents the sloped first surfaces 240 of the outer cap 20 from ratcheting or riding up and over sloped first surfaces 150 of the inner cap 30. Thus, when the outer cap 20 is rotated in an opening direction, here counterclockwise, with the use of both rotational and axial force, the sloped first surfaces 240 of the outer cap 20 are prevented from ratcheting over sloped first surfaces 150 but instead engage one another to transmit torque between sloped first surfaces 240 and sloped first surfaces 150 to thereby rotate the inner cap 30 causing it to disengage from the threaded portion 50 of the container 40.

This is the presently preferred form for effecting the child resistant feature of the present invention. Of course, other means for drivingly connecting the inner and outer cap members relative to one another may be employed without departing from this invention. See for example, U.S. Pat. No. 5,579,934 (herein incorporated by reference) for suitable alternatives.

It is to be understood that the reversible closure device provided in accordance with the present invention can be formed of any suitable material such as plastic or metal or a combination of materials and the like and that the invention is not intended to be limited by the material from which the devices are formed.

It will also be apparent to those skilled in the art that various modifications and variations can be made to the closure of the present invention without departing from the spirit or scope of the invention. Thus, it is intended that the present invention cover the modifications and variations of this invention provided they come within the scope of the appended claims and their equivalents. Accordingly, the invention is not limited by the embodiments described above which are presented as examples only but can be modified in various ways within the scope of protection defined by the appended patent claims.

We claim:

1. A reversible child resistant closure for use with a container comprising a neck and an engaging means, the closure having a child resistant mode when applied to the container in a first child resistant orientation and having a non-child resistant mode when applied to the container in a second non-child orientation, the closure comprising:

An outer cap comprising a first circumferential sidewall extending from a top edge to a bottom edge, and an inward depending wall segment connected to said first circumferential sidewall and forming an annular channel therebetween, said first circumferential sidewall having an inner surface comprising a ridge disposed about the bottom edge, a non-child resistant engaging means for rotateable engagement with an engaging means of the container, and said inward depending wall segment comprising a first child resistant engaging means comprising a series of angular abutments extending from the lower edge of the inward depending wall segment: and an inner cap comprising an upper surface, a second circumferential sidewall extending axially from said upper surface through a closure plane and forming a first annular lip below the closure plane inside a third circumferential sidewall that is connected to said second circumferential sidewall at said closure plane, wherein said third circumferential sidewall extends above and below the closure plane and has a first inner surface below the closure plane provided with a second child resistant engaging means for rotateable engagement with the engaging means of the container, and above the closure plane, the third circumferential sidewall provides a second annular lip for engagement with annular channel on the outer cap; and radially disposed from said second annular lip, adjacent the closure plane, is a third child resistant means having a plurality of angular abutment surfaces complementary to the series of angular abutments on the outer cap, the inner cap being coaxially positioned and nested within the outer cap and axially movable between the first child resistant engaging means of the outer cap and the ridge at the bottom edge of the outer cap such that the plurality of angular abutment surfaces of the inner cap can engage the series of angular abutments of the outer cap upon rotation of the outer cap to rotate the inner cap in a closing direction and in the absence of an axial force, cam over and past the series of angular abutments of the outer cap upon rotation of the outer cap member in an opening direction to prevent rotation of the inner cap.

2. The closure of claim 1 further comprising means for indicating complete closure.

3. The closure of claim 2, wherein the inner cap comprises a complete-closure indicating means on the lower edge of the third circumferential sidewall designed to engage a complimentary means on the neck of the container.

4. The closure of claim 3, wherein the complete-closure indicating means on the lower edge of the third circumferential sidewall comprises one or more tabs, and the complimentary means on the container comprises one or more depressions in a flange on the neck of the container.

5. The closure of claim 3, wherein the complete-closure indicating means on the lower edge of the third circumferential sidewall comprises one or more depressions, and the complimentary means on the container comprises one or more tabs in a flange on the neck of the container.

6. The closure of claim 1 or claim 2, wherein the outer cap further comprises griping means having a plurality of knerlments disposed about an outer surface of the outer cap.

7. The closure of claim 1 or claim 2, wherein the angular abutments of the outer cap comprise a first sloped side and a second vertical side, wherein the first sloped side and second vertical side define a first angle in a range of about 22 degrees to about 45 degrees.

8. The closure of claim 7, wherein the first angle is a range from about 25 degrees to about 33 degrees.

9. The closure of claim 1 or claim 2, wherein the angular abutments of the inner cap comprise a first sloped side and a second vertical side, wherein the first sloped side and second vertical side define a second angle in a range from about 22 degrees to about 45 degrees.

10. The closure of claim 9, wherein the second angle is a range from about 25 degrees to about 33 degrees.

11. The closure of claim 1 or claim 2, wherein the first angle is substantially complementary but not equal to the second angle.

12. The closure of claim 1 or claim 2, wherein the top edge of the outer cap surrounds a central opening to expose the inner cap.

13. The closure of claim 1 or claim 2, wherein the closure further compromises a liner adjacent an inner surface of the inner cap.

14. The closure of claim 13, wherein the liner is a double imprinted liner.

15. The closure of claim 14, wherein on one side of the liner for use in the child-resistant mode is marked the mechanism for removal of the cap, and on the other side of the cap, for use in the non-child resistant mode, is marked a cautionary statement indicating that the is not child-resistant.

16. The closure of claim 15, wherein the marking indicating the mechanism for cap removal in the child-resistant mode is in green and the marking indicating that the cap is in the non-child resistant mode is in red.

17. The closure of claim 1 or claim 2, wherein the upper surface of the inner cap comprises an inner surface on which is marked a warning.

18. The closure of claim 17, wherein the warning comprises the words CAUTION NOT CHILD RESISTANT.

19. The closure of claim 18, wherein the warning is molded into the plastic and highlighted with red ink.

* * * * *